US005315724A

United States Patent [19]

Trujillo et al.

[11] Patent Number: 5,315,724

[45] Date of Patent: May 31, 1994

[54] COMBINATION FIRE TOOL

[76] Inventors: Mark Trujillo, 4691 W. Tufts, Denver, Colo. 80236; Robert Terry, 27637 S. Whirlaway, Evergreen, Colo. 80439

[21] Appl. No.: 922,175

[22] Filed: Jul. 29, 1992

[51] Int. Cl.[5] ..... B25D 1/04

[52] U.S. Cl. ..... 7/145; 7/161; 7/166

[58] Field of Search ..... 7/145, 159, 161, 166; 30/308.1; 254/26

[56] References Cited

U.S. PATENT DOCUMENTS 1,265,276 5/1918 Stephens ..... 30/308.1
1,875,612 9/1932 Johnson ..... 7/161
3,599,255 8/1971 Carroll ..... 7/145 X

FOREIGN PATENT DOCUMENTS 506625 9/1930 Fed. Rep. of Germany ..... 7/145

*Primary Examiner*—James G. Smith
*Attorney, Agent, or Firm*—John L. Isaac

[57] ABSTRACT

A combination fire axe includes an elongated handle, a head member disposed at one end of the handle, and a pike member disposed at the opposite end of the handle. The head member includes a base portion secured to the handle and a cutting portion having a convex edge disposed on one side of the base portion. An enlarged end portion having a blunt face is disposed on the opposite side of the base portion. An elongated substantially flat top portion and a grip members are defined in the head member for operating and controlling the pike member. The pike member includes a base portion secured to the handle, a wedge-shaped pike end portion, and a hook member extending transversely outwardly from the pike member.

12 Claims, 2 Drawing Sheets

COMBINATION FIRE TOOL

BACKGROUND OF THE INVENTION

1. Field of the Invention

The present invention relates generally to fire fighting tools and, more particularly, to a fireman's axe. Specifically, the present invention relates to an improved combination fire tool performing the functions of a plurality of fire fighting tools previously required heretofore.

2. Description of the Prior Art

Fire fighters are frequently confronted with unpredictable situations wherein a number of different types of tools might be required. Fire fighters commonly faced the problem of making quick entries into buildings or quick exits through walls or doors in emergency situations. Gaining entry into buildings often requires a prying action to dislodge members from doorways and windows. A hammering action is also required for breaking out windows and doors to gain entry. It is also frequently required to pull down ceilings of drywall or lathe and plaster in order to investigate or gain access to fire location in a building.

As a result of the above, most fire fighters find they may need considerably more than just one particular tool but must make a choice of carrying only one or two. Heretofore, several fire fighters needed to coordinate with each other to bring into the fire area an axe, a sledgehammer, a pry bar and/or a pike pole in order to accomplish any of the aforementioned tasks. Consequently, several fire fighters have needed to carry in a plurality of different tools in order to have the proper number and types of tools available. Unfortunately, tools that are not being used at a particular time must be set down and are frequently lost due to their being forgotten or covered by falling debris. As a result, numerous tools needed on site are lost during the course of fighting a fire.

Combination firefighter tools have evolved-over the years in order to attempt to alleviate some of the duplication of separate tools discussed above. U.S. Pat. Nos. 3,219,316, 3,599,255, 3,604,028, 4,287,623, 4,597,123, 5,044,033, and Des. No. D120,609 and No. D233,405 all disclose various fireman combination tools. Unfortunately, such combination tools have generally been limited in their multiple purposes and have generally been in the size and form of hand axes. While the device disclosed in U.S. Pat. No. 4,287,623 has a plurality of different purposes, its complexity of parts and operation defeats the purpose of having one sturdy tool at a fire site.

Other utility patents disclosing combination tools, generally in the form of hand axes, includes U.S. Pat. Nos. 89,013, 292,168, 637,253, 790,973, 1,596,602 and 4,030,150 as well as Des. Nos. D35,154, D45,761, 48,231, D67,749, D163,911 D299,414. These remaining patents, both design and utility, illustrate a variety of combination tools which also attempt to serve a multiplicity of purposes. However, none of the aforementioned references disclose a combination fire tool which serves multiple purposes so as to avoid the requirement of separate axes, sledgehammers and pike poles as well as other tools. Therefore, there remains a need for a combination fire tool which is sturdy and simple in design and function.

SUMMARY OF THE INVENTION

Accordingly, it is one object of the present invention to provide a combination fire tool.

It is another object of the present invention to provide an improved fire tool serving a multiplicity of purposes to obviate the requirement of a plurality of tools at a fire site.

Yet another object of the present invention is to provide a fire axe designed for multi-purpose use which is simple in construction and operation.

To achieve the foregoing and other objects and in accordance with the purpose of the present invention, as embodied and broadly described herein, a combination fire tool is disclosed. The fire tool includes an elongated handle with a head member disposed at one end of the handle and a pike member disposed at the opposite end of the handle. The head member includes a base portion secured to the handle and a cutting portion having a convex edge disposed on one side of the base. An enlarged end portion having a blunt face is disposed on the opposite side of the base, and the head member further includes an elongated substantially flat top portion. A gripping mechanism is defined in the head member for operating and controlling the pike member. The pike member includes a base portion secure to the handle and a wedge-shaped pike end portion. Finally, a hook member extends transversely outwardly from the pike member.

BRIEF DESCRIPTION OF THE DRAWINGS

The features of the present invention which are believed to be novel are set forth with particularity in the appended claims. The invention, together with further objects and advantages thereof, may best be understood by reference to the following detailed description taken in conjunction with the accompanying drawings, in which:

DETAILED DESCRIPTION OF THE PREFERRED EMBODIMENTS

Figure 1:
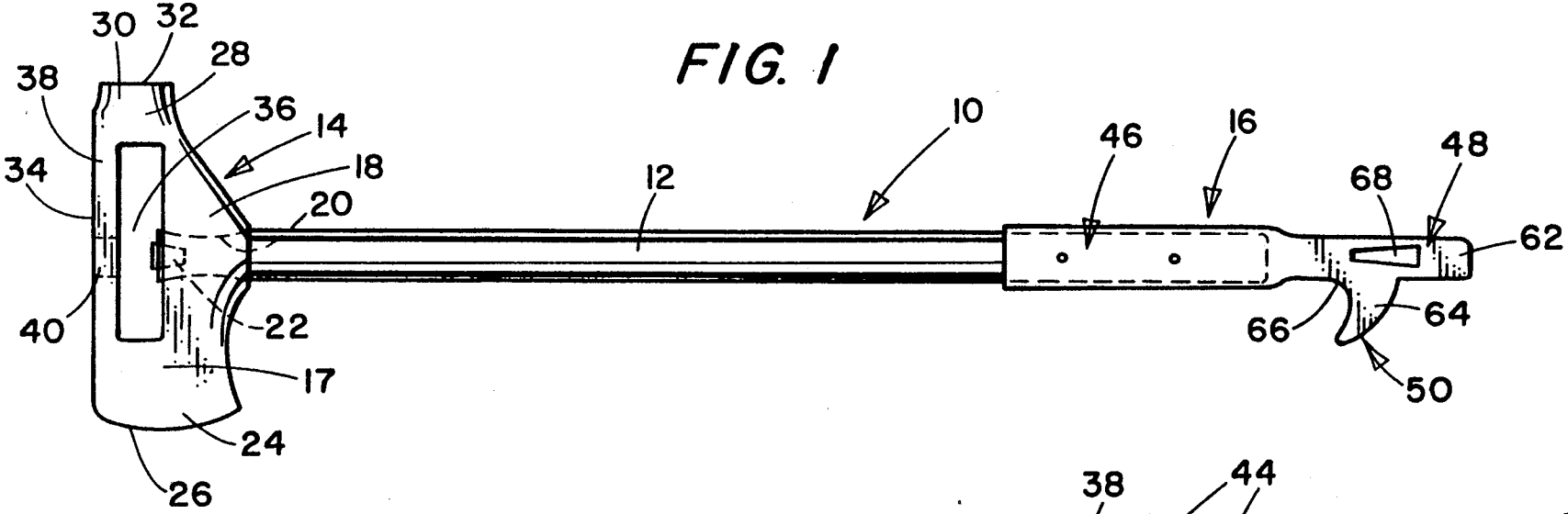
FIG. 1 is a side perspective view of the combination fire tool of the present invention.
Figure 2:
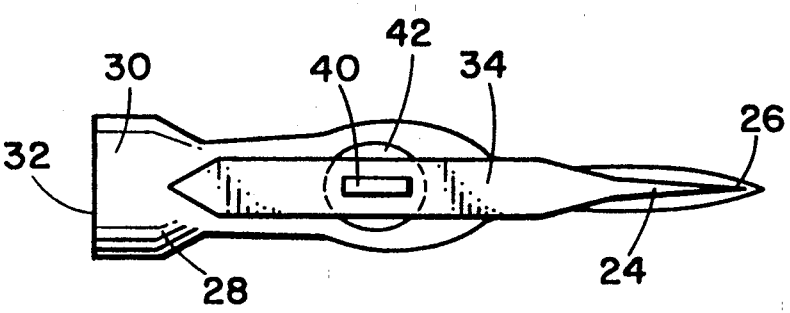
FIG. 2 is a top planned view of the head member of the tool illustrated in FIG. 1.
Figure 6:
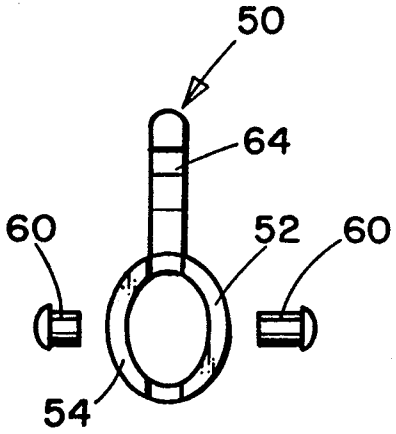
FIG. 6 is an end view of the pike member illustrated in FIG. 4.
Figure 4:
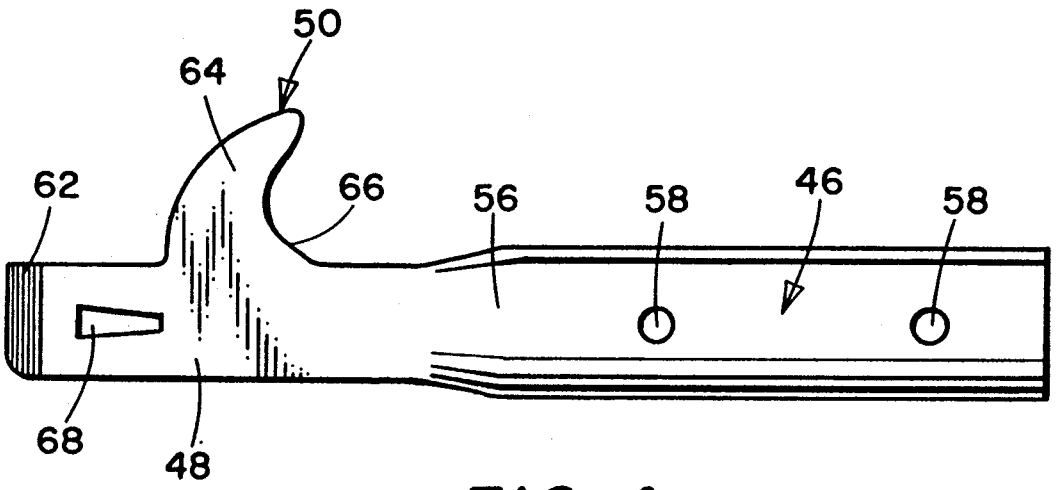
FIG. 4 is an enlarged side perspective view of the pike member of the embodiment illustrated in FIG. 1.
Figure 5:
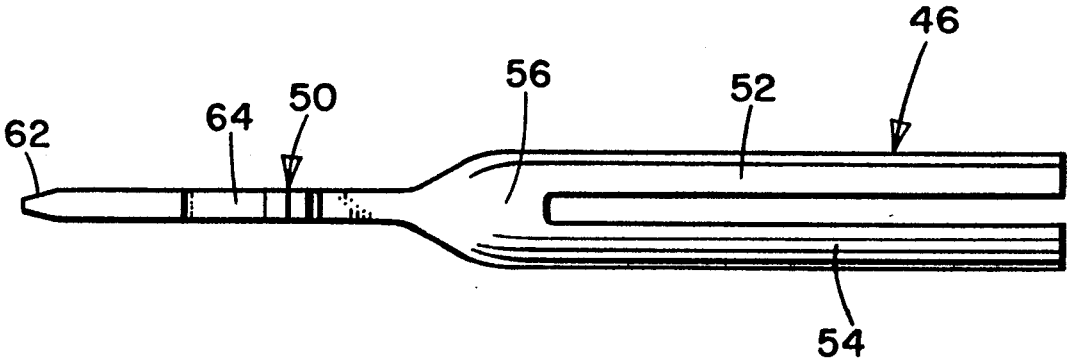
FIG. 5 is a top perspective view of the pike member illustrated in FIG. 4.

Referring with particularity to FIGS. 1 and 2, a combination fire tool 10 is disclosed. The tool 10 includes an elongated handle 12 having a head portion 14 disposed at one end and a pike portion 16 disposed at the opposite end. The handle 12 may be constructed from any appropriate material such as wood, fiberglass or light weight metals. The length of the handle 12 is preferably 28 to 45 inches and it is preferably sized so as to give an overall tool length of 36–42 inches and optimally 40 inches. This optimal and preferred length of tool 10 will provide a user of the tool 10 with sufficient leverage when swinging the tool 10 utilizing the head portion 14 as well as for pushing/pulling the tool 10 utilizing the pike portion 16. Lengths greater than those set forth above will generally provide a tool 10 that is unwieldy and cumbersome to use, and lengths which are less than those set forth above will not provide adequate leverage or reach when utilizing the tool 10.

The head portion 14 includes a head member 17 having a base 18 to which the handle 12 is secured. The base 18 includes a bore 20 disposed therein which is sized and shaped to receive the upper portion of the handle 12. Preferably, bore 20 is slightly constricted in width in its center, as in an hour-glass shape, so as to provide a tight wedging force against the handle 12 when it is inserted therein. The handle 12 may be secured within the bore 12 by gluing, bolting or wedging, depending upon the material from which the handle 12 is made. In preferred form, the handle 12 is made from wood, and the handle 12 is press fit within the bore 20. A wedge 22 is then preferably driven into the upper end of the handle 12 in traditional fashion and as discussed in greater detail below.

The head 17 also includes a convex cutting portion 24 in the form of an axe having a cutting edge 26. The convex cutting portion 24 is disposed on one side of the base 18. An enlarged end portion 28 is disposed on the opposite side of the base 18 and is preferably in the form of a substantially cylindrical member 30 having a blunt face 32 which is substantially parallel to the handle 12. The end portion 28 functions as a mallet or sledgehammer. The top portion 34 of the head 16 is preferably in the form of an elongated flat portion which can function as a ram face when the tool 10 is so utilized as described below.

An enlarged, preferably rectangular opening 36 is disposed entirely through the head 17 so as to provide a grip member 38 forming the top end of the head 17. The grip opening 36 and grip member 38 are provided so that a user of the tool 10 can, with a large fire glove on, grab the head 17 by passing their hand entirely through the opening 36 and grasping the grip member 38. In this manner, the operator of the tool 10 can easily utilize the pike end 16 as described below.

In order to permit the wedge 22 to be inserted into the handle 12 within the bore 20, a slot 40 is provided in the grip member 38 through which the wedge 22 can pass and be oriented into the end portion 42 of the handle 12. An appropriate tool can then be utilized through the slot 40 to drive the wedge 22 into the end 42 of the handle 12. Without this slot 40, the insertion of the wedge 22 into the end portion 42 would be awkward and difficult at best and perhaps almost impossible absent any special tools designed to perform such a function.

Figure 3:
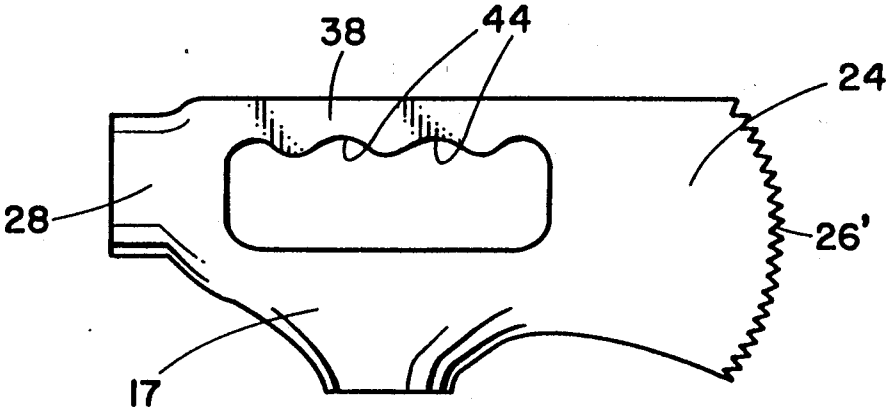
FIG. 3 is an enlarged side perspective view of an alternate embodiment of the head member of the tool of the present invention.

An alternate embodiment for the head portion 16 is illustrated in FIG. 3 and includes a convex cutting portion or axe 24 having a serrated cutting edge 26'. The serrated cutting edge 26' is particularly useful when the axe 24 is being utilized to cut through aluminum alloy sheeting such as found in aircraft and the like as described below. The embodiment illustrated in FIG. 3 also discloses finger notches 44 which may optionally be disposed along the inner surface of the grip member 38. Such finger notches 44 are sized and shaped to permit a firmer grasp of the head 17 and grip member 38 by an operator of the tool 10.

Referring now with particularity to FIGS. 1 and 4–6, the pike portion 16 is disposed on the opposite end of the handle 12 from the head portion 14. The pike portion 16 preferably includes a base 46, which is utilized to attach the pike 16 to the handle 12, a pike end 48 and a hook portion 50. The base 46 may be in the form of a tube adapted to receive the handle 12 or, in preferred form and as illustrated in the drawings, in the form of a pair of bracket members 52, 54 which project in elongated fashion from a base cup 56. The cup 56 is sized to receive the very end of the handle 12, and the brackets 52, 54 are shaped to fit about the curved surface of the handle 12. This arrangement permits adaptation of the pike base 46 for a variety of sized handles 12. Each bracket 52, 54 preferably includes a pair of apertures 58 through which rivets or bolts 60 attach the brackets 52, 54 to the handle 12.

The pike end 48 preferably includes a wedge-shaped or tapered distal end 62 which functions as a pry bar. The hook portion 50 is in the form of a hook member 64 extends transversely outwardly relative to the axis of the handle 12. In preferred form, the hook 64 is curved so as to angle back toward the head portion 14 so as to form a nesting area 66 between the hook 64 and the cup 56. The nesting area 66 is utilized when swinging the tool 10 as described below.

In one embodiment of the present invention, a tapered slot 68 may be formed in the pike end portion 48. The slot 68 enables the pike end portion 48 to function as a gas valve shut off member. The slot 68 is tapered so as to enable it fit over a variety of different sizes of gas valve shut off handles.

In preferred form, both the head portion 14 and the pike portion 16 are constructed from steel which can be hardened or tempered. However, the steel is not required to be tempered or heat treated because a sharp edge is not necessary on the cutting edge 26. In fact, a sharp edge on the cutting edge 26 can cause unnecessary injuries. In preferred form, the head portion 14 and pike portion 16 are constructed from 4140 steel.

The size of the head portion 14 and the weights of the head and pike portions 14, 16 are selected to provide a maximum preferred weight for the tool 10 of 16 pounds. In more preferred form, the overall tool 10 should weigh approximately 12–13 pounds, with the head being 8–8.5 pounds and the pike portion 16 being about 3–4 pounds. The weight should be sufficient to enable the tool to be easily utilized for its designed functions as described below, yet not so heavy as to be overly cumbersome or difficult to use.

In operation, the head portion 14 of the tool 10 may be utilized for a variety of purposes. The sledge end 28 is useful for hitting locked wood or metal doors, including dead bolts, to gain entry by a fire fighter. It may also be used to drive another tool into door jams for entry as well as hitting a surface that requires significant force to more or remove it from its original position. The top end portion 34 may be utilized as a light ram for drywall or lathe and plaster to remove large areas quickly in order to access a room or investigate for fire behind walls. The axe portion 24 is utilized to cut holes in roofs, floors and walls. Additional uses include chopping wood or soft metals to again gain access to rooms or through doors that are bolted tight. Due to the extra weight of the sledge end 28, the axe portion 24 has significantly additional force when cutting as compared to regular fire axes. As previously discussed, the serrated edge 26' of FIG. 3 is particularly useful for cutting aluminum metals and other light weight metals in aircraft fires and the like.

The tapered portion 62 of the pike end 48 is utilized for getting behind or inbetween wood work such as base boards, door trim, shelves and cabinets. This type of prying action is necessary to investigate for smoldering or hidden fires. The tapered end 62 is also used to pry away items from or off walls. It is also useful for prying door hinges and the like, and significant leverage is obtained from the length of the handle 12. The grip opening 36 and grip member 34 of the head portion 14 is utilized when operating the prying and wedging capability of the pike end 48. In addition, the hook 64 is used to pull down ceilings of drywall, drop or lathe and plaster. To utilize the hook portion 50 of the pike end 16, the head 17 is grasped through the grip opening 36 and the grip member 38, and the pike portion 16 is then shoved up and through ceilings. The hook 64 then utilized to pull down the ceilings. In this manner, the grip member 38 enables an operator of the tool 10 to easily punch the pike portion 16 through ceilings due to the extensive reach capability due to one arm operation of the tool 10. Moreover, the weight of the head portion 14 assists in pulling down ceiling materials when using the hook 64.

An additional advantage of the tool 10 is the nesting area 66 at the base of the hook portion 50. When the axe 24 or the sledge end 28 of the tool 10 is utilized in a swinging fashion, the hook portion 50 and nesting area 66 permit a more secured grasp by enabling the operator to lock a hand in the nesting area 66 when swinging the tool 10 and the head portion 14 so that the tool 10 does not inadvertently slide out of the grasp of the operator. Moreover, the nesting area 66 provides additional leverage when swinging the tool 10.

Prior to the present invention, fire fighters have required a variety of tools at a fire area such as an axe, a sledgehammer, a pry bar or a pike pole. Each of these tools have different purposes when fighting a fire. As can be seen from the above, the present invention combines five of such tool functions into one combination tool, that of an axe, sledgehammer, pry bar, pike pole and light ramming tool. Moreover, a combination of these features into one tool generates a synergistic relationship in that the hook end provides for greater leverage and safety when swinging the axe portion, and the grip member of the head portion provides for easier and more effective use of the pike portion. By providing only one combination tool for these multiple purposes, increased efficiency is obtained for the fire fighter in that multiple tools are not required to be switched during the course of fighting a fire. Moreover, the present invention will provide for significant reduction in tool losses during the course of fighting a fire.

As can seen from the above, the present invention provides for a very efficient and effective combination fire tool which takes into effect a variety of different fire fighting functions with the use of only one tool. This increases efficiency and speed of fighting a fire as well as significantly reduces tool loss. Moreover, fire fighters will always have the required tool available since one tool will function for a plurality of different uses. Previous to the present invention, fire fighters occasionally found themselves on the scene with the incorrect tools required to fight the fire, thereby necessitating returning to the fire truck to obtain different tools. Such delays cause needless damage as well as increased risks to the fire fighter. The present invention obviates this problem by providing basic fire fighting tool requirements all in one tool.

The foregoing description and the illustrative embodiments of the present invention have been shown in the drawings and described in detail with varying modifications and alternate embodiments. It should be understood, however, that the foregoing description of the invention is exemplary only, and that the scope of the invention is limited only to the claims as interpreted in view of the prior art.

We claim:

1. A combination fire tool comprising:

an elongated handle;

a head member disposed at one end of said handle and a pike member disposed at the opposite end of said handle;

said head member including a base portion secured to said handle, a cutting portion having a convex edge disposed on one side of said base portion, an enlarged end portion in the form of a sledge hammer disposed on a second side of said base portion, an elongated substantially flat top portion forming a ram, and grip means defined in said head member for operation and use of said pike member;

said pike member including a base portion secured to said handle, a substantially wedge-shaped pike end portion, and a hook member extending transversely outwardly from said pike member and defining a nesting area to provide an operator rotation point when swinging said head member; and said fire tool being approximately 36" to 42" in length with said tool being approximately 12–13 lbs. in weight.

2. The tool as claimed in claim 1, wherein said cutting portion comprises an axe.

3. The tool as claimed in claim 2, wherein said convex edge of said axe is serrated.

4. The tool as claimed in claim 1, wherein said grip means comprises a opening defined in said head member sized and shaped to receive the hand of an operator of said tool, the weight and opening of said head member assisting in ease and effectiveness of use of said hook member.

5. The tool as claimed in claim 4, wherein said grip opening further includes finger notches disposed along one surface thereof.

6. The tool as claimed in claim 1, wherein said hook member is curved toward said head member and defines an inner curved surface facing said head member, said nesting area being defined as the inner curved surface of said hook member and its intersection with said pike member base portion.

7. The tool as claimed in claim 1, wherein said wedge-shaped pike end portion comprises a pry member.

8. The tool as claimed in claim 1, wherein said pike member includes a tapered slot defining a gas valve shutoff member.

9. A combination fire tool comprising;

an elongated handle being approximately 36" to 42" in length;

a pike member at one end of said handle including a tapered pry bar end member and a hook oriented transverse to said handle, said hook having an inner curved surface defining a curved nesting area therealong to provide a pivot point when swinging said tool;

a head member at the opposite end of said handle weighing approximately 8–8.5 lbs. and including a base, an axe portion, a sledge hammer disposed opposite said axe portion, a flat top surface to function as a ram, and a grip opening to permit the holding and operation of said tool when using said pike member, the weight and opening of said head member assisting in ease and effectiveness of use of said pike member hook; and said fire tool being approximately 38" to 42" in overall length and approximately 12–13 lbs. in weight.

10. The fire tool as claimed in claim 9, wherein said fire tool is approximately 40 inches in length.

11. The fire tool as claimed in claim 9, wherein said grip opening further includes finger notches disposed therein to increase the gripping surface of said head when using said pike member.

12. The fire tool as claimed in claim 9, wherein said pike end further includes a V-shaped slot which defines a gas meter valve shut off member.

* * * * *